United States Patent [19]

Johannsen

[11] 4,398,082

[45] Aug. 9, 1983

[54] HEATING APPARATUS

[75] Inventor: Robert Johannsen, Algonquin, Ill.

[73] Assignee: Aubrey Manufacturing, Inc., Union, Ill.

[21] Appl. No.: 241,758

[22] Filed: Mar. 9, 1981

[51] Int. Cl.[3] ..... F24H 3/04; H05B 1/00

[52] U.S. Cl. ..... 219/370; 219/374; 219/366; 338/58; 338/287; 338/288; 338/290

[58] Field of Search ..... 219/366, 369, 370, 374, 219/375, 376, 377, 550; 338/58, 286, 290, 304, 305, 320, 321

[56] References Cited

U.S. PATENT DOCUMENTS

| | | | |
|---|---|---|---|
| 1,129,381 | 2/1915 | Carlson | 338/286 |
| 1,967,713 | 7/1934 | Kelley | 219/370 |
| 2,492,248 | 12/1949 | Weingardt | 219/370 |
| 2,866,073 | 12/1958 | Omohundro | 219/370 |
| 3,043,942 | 7/1962 | Wickwire et al. | 338/290 |
| 3,111,573 | 11/1963 | Crowe et al. | 219/370 |
| 3,725,640 | 4/1973 | Kunz et al. | 219/370 |

*Primary Examiner*—B. A. Reynolds
*Assistant Examiner*—Marvin M. Lateef
*Attorney, Agent, or Firm*—Irwin C. Alter

[57] ABSTRACT

An improved heating apparatus for heating a small room or confined space has an electric heater element affixed to a mounting frame assembly by means of notched heater element supports. The notched heater element supports are operably disposed within slots located around the periphery of the mounting frame assembly. When the heater element is strung through the supports, and stretched therebetween, the supports are biased into a locked position. Cool air is drawn through louvers located in the side panels of the upper housing portion and blown through the mounting frame assembly by a fan located at the rear of the apparatus housing. The cool air is warmed by the heater element and warm air is blown through a front grill attached to the front panel of the apparatus housing.

1 Claim, 8 Drawing Figures

HEATING APPARATUS

BACKGROUND OF THE INVENTION

The present invention related in general to heating equipment and particularly to an improved electric heater for heating a room or confined space.

With an ever increasing concern relative to energy efficiency and product safety, a great deal of activity has been initiated recently in improving electric room heaters.

While electric heaters using a resistance type heater element are not new, the manner in which the heater element is mounted varies and may contribute to the overall efficiency of the unit. Although safety is the overriding concern in heater element mounting, compact size and cost efficiency are also considered.

In the past, the heater element has been mounted on screw terminals. The drawback in using the screw terminal is twofold in that firstly, a metallic screw conducts both heat and electricity and could serve as a safety hazard if not properly insulated, and secondly, a screw terminal which becomes loosened over time could fail altogether in supporting the heater element.

Many heater element supports require multiple components and elaborate mounting methods. The widely used screw terminal mounting normally includes multiple insulators, washers and fastening bolts.

Accordingly the present invention has as an object the provision of a single piece insulating support for mounting the heater element.

An additional object of the invention is to provide a heater element support which is biased into a locked position on a mounting frame by the supporting weight of the heater element.

It is additionally an object of the present invention to provide a non-metallic means for mounting the heater element.

It is further an object of the invention to provide such a heater element support which is easily mounted and removed for installation and service.

Still another object of the invention is to provide a heater element support that can be installed without the use of special tools.

Yet another object of the invention is to provide a low cost heater element support.

Another object of the invention is to provide a compact heater element support which occupies a minimum amount of space within the heating apparatus.

An object of the present invention is to provide a heater element support which utilizes the heater element's own resiliency to secure the mounting means while accurately and securely positioning the heater element in the flow path of air to be heated.

These and other objects of the invention will become apparent in light of the present specification.

SUMMARY OF THE INVENTION

The present invention is an improved heating apparatus, for heating a small room or confined space.

The apparatus comprises a housing which includes an upper housing portion mating with a lower housing portion. There is an air inlet on one of the housing portions and air outlet on the remaining housing portion. A fan is disposed within the lower housing portion, between the air inlet and the air outlet. A mounting frame assembly is disposed within the lower housing portion between the fan and the air outlet. The frame assembly has a multiplicity of slots positioned horizontally and vertically arounds its periphery. Positioned within selected slots are heater element supports. A heater element is strung through and between the supports, and thereby the supports are retained within their individual slots. A switch is provided to control the selective operation of the fan and the heater elements.

In a preferred embodiment of the invention, the heater element supports include an eyelet and a tab. The eyelet maintains the heating element in a fixed position such that the heater element does not come into direct contact with the mounting frame assembly or the housing. The heater element support is retained within its respective slot by a notched tab. The tab is of a size and shape such that it will be received within a slot. When the heater element is strung through the eyelet, the tab is biased against the edge of the slot and thereby retained within the slot. The heater element supports are ceramic and do not conduct heat nor electricity. This safety feature prevents burns and electric shock.

Heater element supports are positioned within slots located in the top member, bottom member and two side members of the mounting frame assembly. Therefore, the heater element supports are retained in both horizontal and vertical slots.

The heater element is a resistance type helical coil which is stretched when strung through and between the insulating eyelets. The stretched heater coil provides the bias to retain the heater element support tabs within their respective slots.

In a preferred embodiment of the invention, the heating apparatus is light weight and small in size. The fan draws room temperature air through louvers located on either side of the apparatus. The air is then blown through the mounting frame assembly, where it is heated by multiple heating element coils. The warm air exits through a front grill.

Located on the mounting frame assembly is an adjustable thermostat, which opens a contact when the apparatus temperature rises above that at which it is set. The thermostat control switch is located on the rear panel of the apparatus and rotates in a clockwise manner about a 270 degree arc. As the switch is rotated, the temperature setting of the apparatus becomes warmer.

Also located on the rear panel of the apparatus is a switch that controls the fan motor and multiple heating element coils. When in the "Off" position, no current is drawn by the apparatus. When in the "Fan" position, the fan motor is energized, causing the fan to rotate. When in the "Warm" position, the fan motor and a single heating element coil is energized. Finally, when in the "Hot" position, the fan motor and all of the heating element coils are energized, producing the maximum amount of heat which the apparatus can generate.

An internally mounted tilt switch, mechanically opens an electrical contact when the heating apparatus is not in an upright position to prevent burns and electrical shock.

DETAILED DESCRIPTION OF THE DRAWINGS

Figure 1:
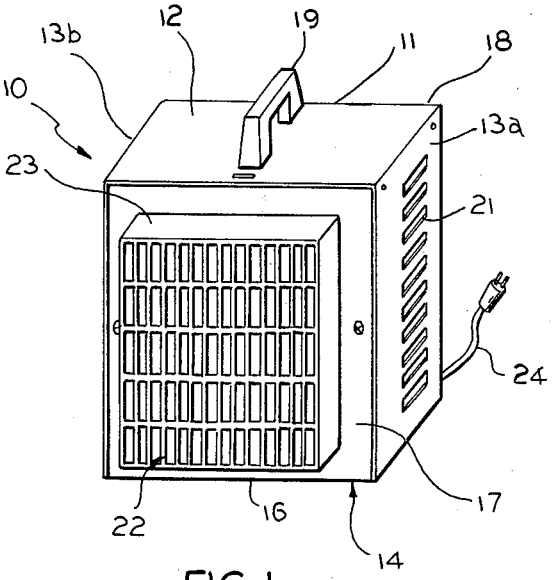
FIG. 1 of the drawings is a front elevational schematic view showing particularly the side louvers through which cool air is drawn and the front grill through which warm air is blown.

While this invention is susceptible of embodiment in many different forms, there is shown in the drawings and will herein be described in detail, several specific embodiments presented with the understanding that this disclosure is to be considered as an exemplification of the principles of the invention and is not intended to limit the invention to the embodiments illustrated.

The preferred embodiment of the invention is shown in FIG. 1, where heater 10 has an upper housing portion 11, comprised of a top panel 12 and two side panels 13*a* and 13*b*. The lower housing portion 14 is comprised of a bottom panel 16, a front panel 17 and a rear panel 18.

A handle 19 is attached to top panel 12 for convenience in transporting heater 10 from place to place. Cool air is drawn through louvers 21, located on side panels 13*a* and 13*b*, and is heated within heater 10. Once the cool air is heated, warm air is blown through grill 22 which is mounted on grill shoulder 23, which in turn is mounted on front panel 17. Also shown in FIG. 1 is electric cord 24 through which electricity is supplied to the heating and control apparatus to be described herein.

Figure 2:
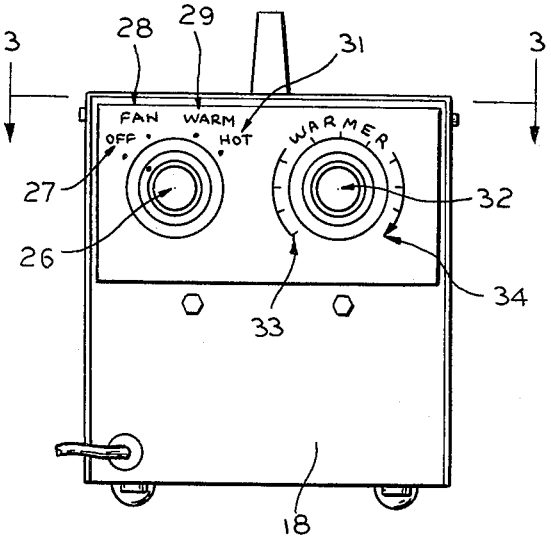
FIG. 2 is a rear elevational view showing the fan control switch and thermostat control switch.

FIG. 2 shows controls 26 and 32, located on rear panel 18. The fan control switch 26 is a multi-position switch with four distinct settings. When the switch 26 is in the "Off" position 27, no electric current is supplied to the heater element or the fan. When switch 26 is in the "Fan" position 28, current is supplied only to the fan motor and cool air is blown through the apparatus without being heated. When switch 26 is in the "Warm" position 29, current is supplied to both the fan motor and one of the multiple heater elements. When switch 26 is located in the "Hot" position 31, current is supplied to the fan motor and both heater elements.

Thermostat control 32 is also a multi-position switch which can be set in an infinite number of positions about a 270 degree arc. When thermostat 32 is rotated in a clockwise manner, the thermostat is adjusted so as not to break the control circuit until higher temperatures are established. When thermostat 32 is located at setting 33, a minimum amount of heat will cause the thermostat to trip the control circuit. When thermostat 32 is located at setting 34, the thermostat will trip only when very high temperatures are generated. Varying degrees of heat will be generated in the numerous positions between 33 and 34.

Figure 3:
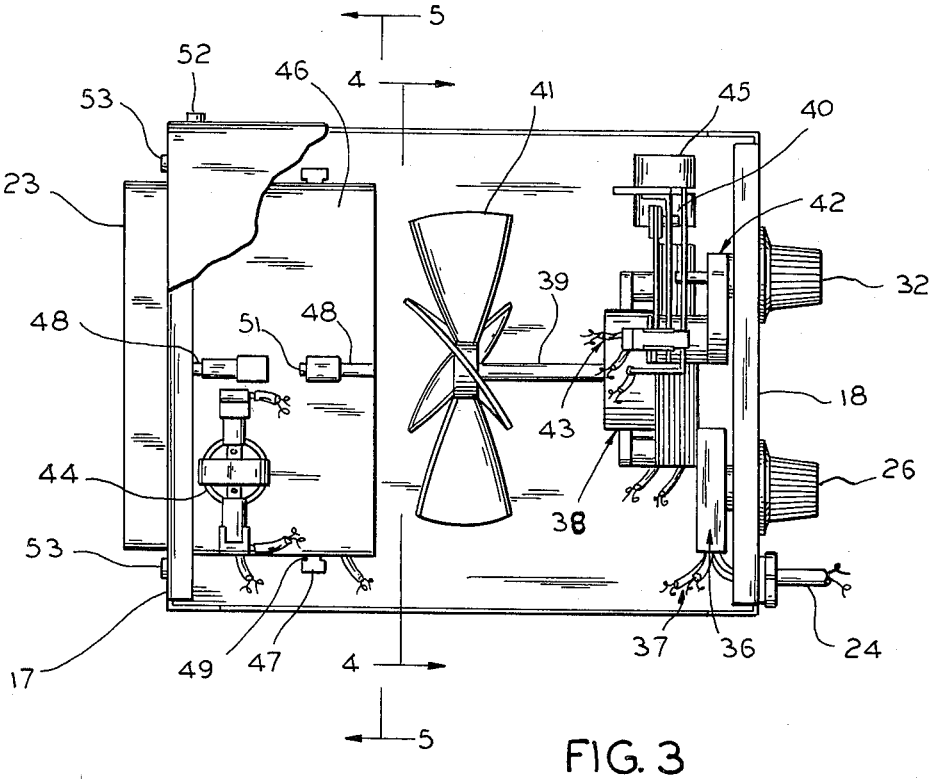
FIG. 3 is a cross-sectional top view of the heating apparatus showing particularly the fan motor, shaft and blade, and the electrical thermostat.

The cross-sectional top view of heater 10 in FIG. 3 shows fan control switch 26 and thermostat control switch 32 attached to rear panel 18. Electric current is drawn through electic cord 24 into fan control switch contact housing 36. Current is then drawn through fan control leads 37 to the fan motor. Fan motor housing 38 rotates causing fan shaft 39 and fan blades 41 to rotate.

Current flows through thermostat control switch contact housing 42 via thermostat control leads 43. Thermostat 44 is located on mounting frame assembly 46 so as to sense the warm air being generated by heating apparatus 10. Also adjacent to thermostat control switch contact housing 42, is a tilt switch 45. If the heating apparatus is tilted in any direction, tilt switch 45 rotates about tilt switch shaft 40 and interrupts the current flowing to heater 10.

Figure 7:
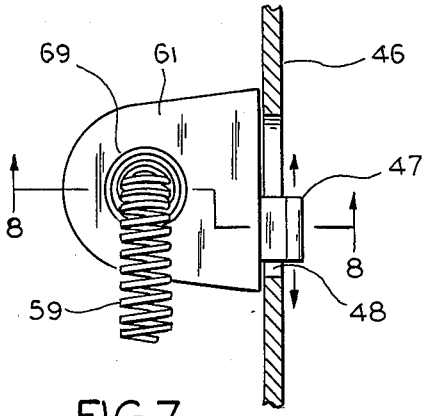
FIG. 7 is an enlarged view of a single heater element support with a section of heater element strung therethrough.

Mounting frame assembly 46 is attached to front panel 17 of lower housing portion 14. Tab 47 of individual heater element support 61 (FIG. 5) protrudes through the mounting frame assembly at the individual slots 47 which are located around the mounting frame periphery. When heater element support 61 is in its locked position, notch 49 in tab 47 is held against front edge 51 of slot 48 (FIGS. 3 and 7).

Lower housing portion 14 is secured to upper housing portion 11 by self-tapping screws 52. Grill shoulder 23 depends from front panel 17 and is attached thereto by self-tapping screws 53. Cool air is thus blown by fan blades 41 through the interior or heating cavity of mounting frame assembly 46 where it is warmed by the heater element attached thereto, and the warm air is thus blown through grill 22 which is mounted within grill shoulder 23.

Figure 4:
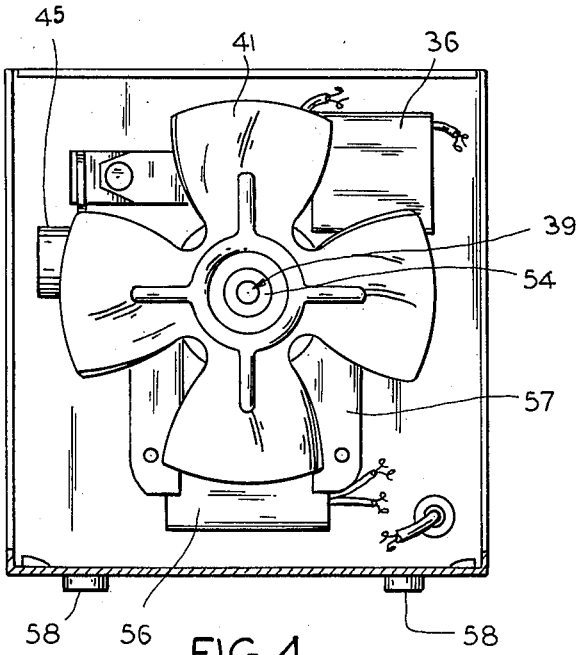
FIG. 4 is a cross-sectional elevated rear view of the fan blades shown in FIG. 3.

FIG. 4 is a front elevational view showing fan blades 41 mounted on fan hub 54, which in turn is mounted on fan shaft 39 and rotated by motor housing 38 in a clockwise direction. Also shown in FIG. 4 is tilt switch 45 and fan control switch contact housing 36. Mounting feet 58 are located on bottom panel 16, which is part of the lower housing portion.

Figure 5:
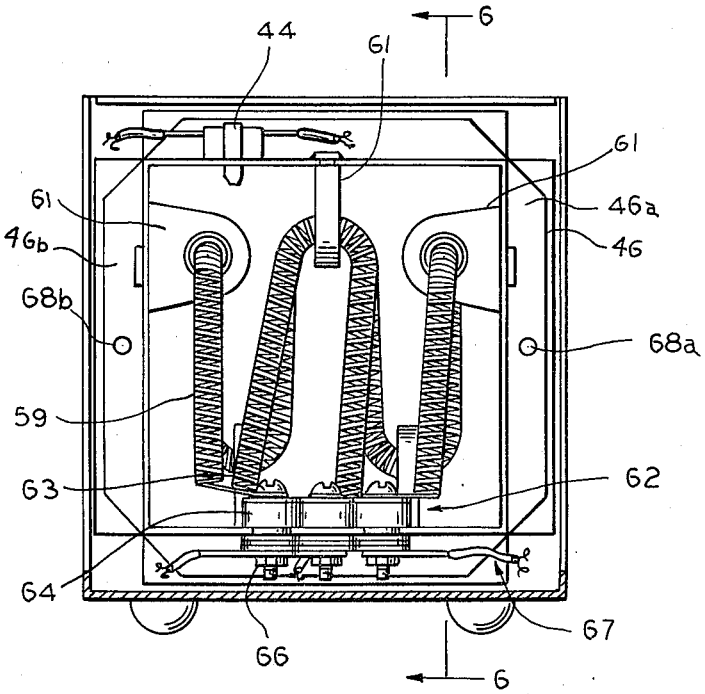
FIG. 5 is a cross-sectional elevated view of the heater element strung through the heater element supports and secured to the heating element terminals.

FIG. 5 illustrates heater element 59 strung between supports 61 in both the horizontal and vertical slots of mounting frame assembly 46. Supports 61 at the horizontal and vertical slots lie in respective, generally perpendicular planes rotated 90° with respect to each other. The end portion of heater element 59 is attached to heater element terminal 62. This terminal is comprised of screw 63, insulating disc 64 and nut 66. Also attached to terminal 62 is power lead 67.

Mounting frame assembly 46 has flanged front end panels 46*a* and 46*b* which are drilled at two points, creating mounting holes 68*a* and 68*b*. Two self-tapping screws are used to attach mounting frame assembly 46 to front panel 17. Also shown mounted on top of mounting frame assembly 46 is a thermostat 44.

Figure 6:
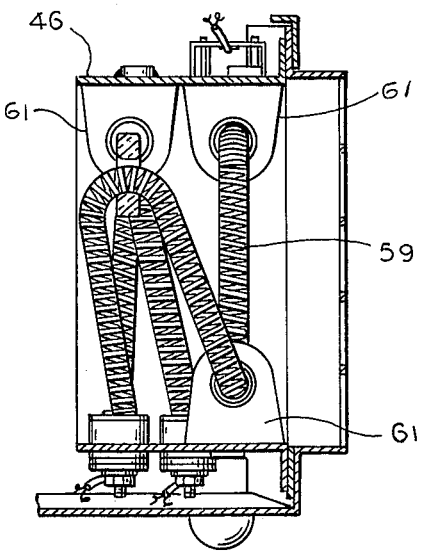
FIG. 6 is a cross-sectional view of the heater element strung through the heater element supports and terminated at the heater element terminals.

The cross-sectional side view shown in FIG. 6, shows heater element 59 stretched between supports 61 in such a manner as to retain each support 61 within its respective mounting slot. The heater element is stretched in a non-planar pattern such that it fills a maximum amount of space within mounting frame assembly 46. This provides for the most efficient heating of the maximum amount of air being forced through mounting frame assembly 46.

FIG. 7 is an enlarged view of a heater element support 61. It shows an eyelet 69 through which heater element 59 is passed. In this manner, support 61 can both support the heater element and prevent the heater element from coming in contact with any metallic parts such as mounting frame assembly 46. The heater element support tab 47 protrudes through slot 48 and locks each support into position when biased toward the end of its mounting slot.

Figure 8:
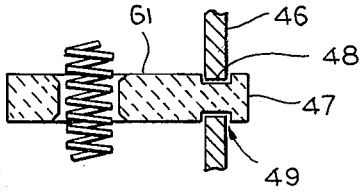
FIG. 8 is an enlarged cross-sectional view of a single heater element support in the locked position.

As shown in FIG. 8, when support 61 is in its locked position, the edge of mounting frame assembly 46 which forms slot 48 is biased against notch 48 in tab 47.

The foregoing description and drawings merely explain and illustrate the invention. The invention is not limited thereto, except insofar as the appended claims are so limited, as those skilled in the art who had the disclosure before them will be able to make modifications and variations therein without departing from the spirit and scope of the invention.

What is claimed is:

1. An improved electrical heating apparatus, said apparatus comprising:

a housing, said housing including an upper housing portion mating with a lower housing portion, an air inlet, said air inlet positioned at one of said housing portions, an air outlet, said air outlet positioned at the remaining of said housing portions;

fan means disposed within said housing for moving air between said air inlet and said air outlet;

mounting frame assembly means disposed within said lower housing portion intermediate said fan means and said air outlet, said frame assembly means including a multiplicity of slots positioned horizontally and vertically around the periphery thereof;

said frame assembly further including a heating cavity for heating air moving between said air inlet and said air outlet;

heater element support means;

said support means positioned at selected of said horizontal slots and at selected of said vertical slots;

heater element means strung across said heating cavity, said heater element means being strung through and between said horizontal and vertical support means in a non-planar configuration to maximize the transfer of heat to air moving through said cavity, each said support means having retaining means formed thereon engageable with one said slot when said heater element means is strung therethrough, said support means positioned at selected of said horizontal slots, said support means positioned at selected of said vertical slots that lie in respective perpendicular planes rotated 90° with respect to each other, said support means including eyelet means which maintains said heating element means in a fixed position such that said heating element do not come into direct contact with said mounting frame assembly, said eyelets being disposed to cause said heating element means to be in a folded convoluted shape when strung through said eyelets and said heating element means having its ends connected by terminals that are in proximate adjacent relationship whereby the heating element means can be disposed in a very small heating cavity and thereby produce efficient heating of the maximum amount of air being moved through the cavity of the apparatus.

* * * * *

UNITED STATES PATENT AND TRADEMARK OFFICE

CERTIFICATE OF CORRECTION

PATENT NO. : 4,398,082

DATED : August 9, 1983

INVENTOR(S) : ROBERT JOHANSEN

It is certified that error appears in the above-identified patent and that said Letters Patent are hereby corrected as shown below:

Inventor: "Robert Johannsen" should be --Robert Johansen--.

Column 4, line 18: "47" should be --48--;

Column 5, line 5: "notch 48" should be --notch 49--;

Column 6, line 23: After "heating element", insert --means--.

Signed and Sealed this

*Sixth* Day of *March 1984*

[SEAL]

*Attest:*

GERALD J. MOSSINGHOFF

*Attesting Officer*

*Commissioner of Patents and Trademarks*